US008028866B2

(12) United States Patent
Martin

(10) Patent No.: US 8,028,866 B2
(45) Date of Patent: Oct. 4, 2011

(54) ALCOHOLIC BEVERAGE DISPENSER

(75) Inventor: Gary D. Martin, Fort Worth, TX (US)

(73) Assignee: Igloo's Frozen Drinks, Ft. Worth, TX (US)

( * ) Notice: Subject to any disclaimer, the term of this patent is extended or adjusted under 35 U.S.C. 154(b) by 571 days.

(21) Appl. No.: 12/142,532

(22) Filed: Jun. 19, 2008

(65) Prior Publication Data

US 2008/0314927 A1 Dec. 25, 2008

Related U.S. Application Data

(60) Provisional application No. 60/944,874, filed on Jun. 19, 2007.

(51) Int. Cl.
*B67D 3/00* (2006.01)

(52) U.S. Cl. ..... 222/485; 222/145.1; 222/183

(58) Field of Classification Search ..... 222/105, 222/129, 145.1, 183, 485
See application file for complete search history.

(56) References Cited

U.S. PATENT DOCUMENTS 2,670,187 A * 2/1954 Goodrich ..... 366/179.1
7,090,098 B2 * 8/2006 Livingston et al. ..... 222/651

* cited by examiner

*Primary Examiner* — Kevin P Shaver
*Assistant Examiner* — Melvin Cartagena
(74) *Attorney, Agent, or Firm* — Kelly J. Kubasta; Klemchuk Kubasta LLP

(57) ABSTRACT

An alcoholic beverage dispenser for receiving individual containers and dispensing alcohol from one or more of the received containers comprising a base having multiple compartments therein each for receiving the individual containers therein. A valve having a valve stem extending therefrom is coupled around the opening of each individual container and each container is in turn connected with a dispensing system within the base. The dispensing system receives liquid from each individual container and dispenses the received liquid through a receiving outlet such as a tap, drink dispenser, or an individual glass.

1 Claim, 4 Drawing Sheets

ALCOHOLIC BEVERAGE DISPENSER

CROSS-REFERENCE TO RELATED APPLICATION

Applicants claim priority based on provisional patent application Ser. No. 60/944,874 filed Jun. 19, 2007, the entire content of which is incorporated herein by reference.

TECHNICAL FIELD

This invention relates generally to beverage containers, and more particularly to an alcoholic beverage container comprising a housing having multiple compartments for receiving individual beverage containers and simultaneously dispensing the contents of the received containers.

BACKGROUND AND SUMMARY OF THE INVENTION

Federal regulations prohibit the sale of distilled alcoholic beverages in containers larger than 1.75 liters. This regulation requires restaurants, bars, and similar establishments to open multiple alcoholic beverage containers in a short amount of time, e.g., a bartender must continuously open and connect new containers with beverage dispensers such as taps, bottle spouts, fountain dispensers, etc. For example, an establishment serving margaritas will require a large amount of tequila in a short amount of time in order to serve a busy crowd during happy hour, etc. A bartender must spend an inordinate amount of time opening and connecting subsequent bottles, thereby reducing time available for other duties such as taking orders, preparing and serving drinks, etc.

The present invention comprises an alcoholic beverage dispenser which overcomes the foregoing and other difficulties which have long since characterized the prior art. In accordance with the broader aspects of the invention an alcoholic beverage dispenser comprises a base having multiple compartments for receiving individual beverage containers therein and a dispensing system for simultaneously dispensing alcoholic beverages from the individual beverage containers.

In accordance with more specific aspects of the invention the dispensing system comprises valves for coupling the opening of each individual beverage container to a delivery system, the valve having a gear wheel thereabout and a valve stem extending therefrom. The valves seat into a valve receiving plate having a lanyard equipped with gear engaging beads for engaging the gear wheels of each valve as the lanyard is rotated in a counterclockwise direction thereby facilitating the flow of liquid from within each individual beverage container. Accordingly, the lanyard may be rotated such that liquid may be flowing simultaneously from one or more individual beverage containers. The valve stem is received into one of a plurality of receiving stems comprising a manifold located beneath the valve receiving plate. The manifold comprises a connector at one end for connecting the dispensing system with a receiving outlet and a control valve for controlling the flow of liquid through the connector into the receiving outlet.

The alcoholic beverage dispenser of the present invention enables a bartender to install multiple individual beverage containers the beverage container and thereafter dispense the alcoholic beverage contained within the multiple containers without requiring removal, replacement, or reconnection of additional individual beverage containers.

BRIEF DESCRIPTION OF THE DRAWINGS

A more complete understanding of the present invention may be had by reference to the following Detailed Description when taken in conjunction with the accompanying Drawings, wherein.

DETAILED DESCRIPTION

Figure 1:
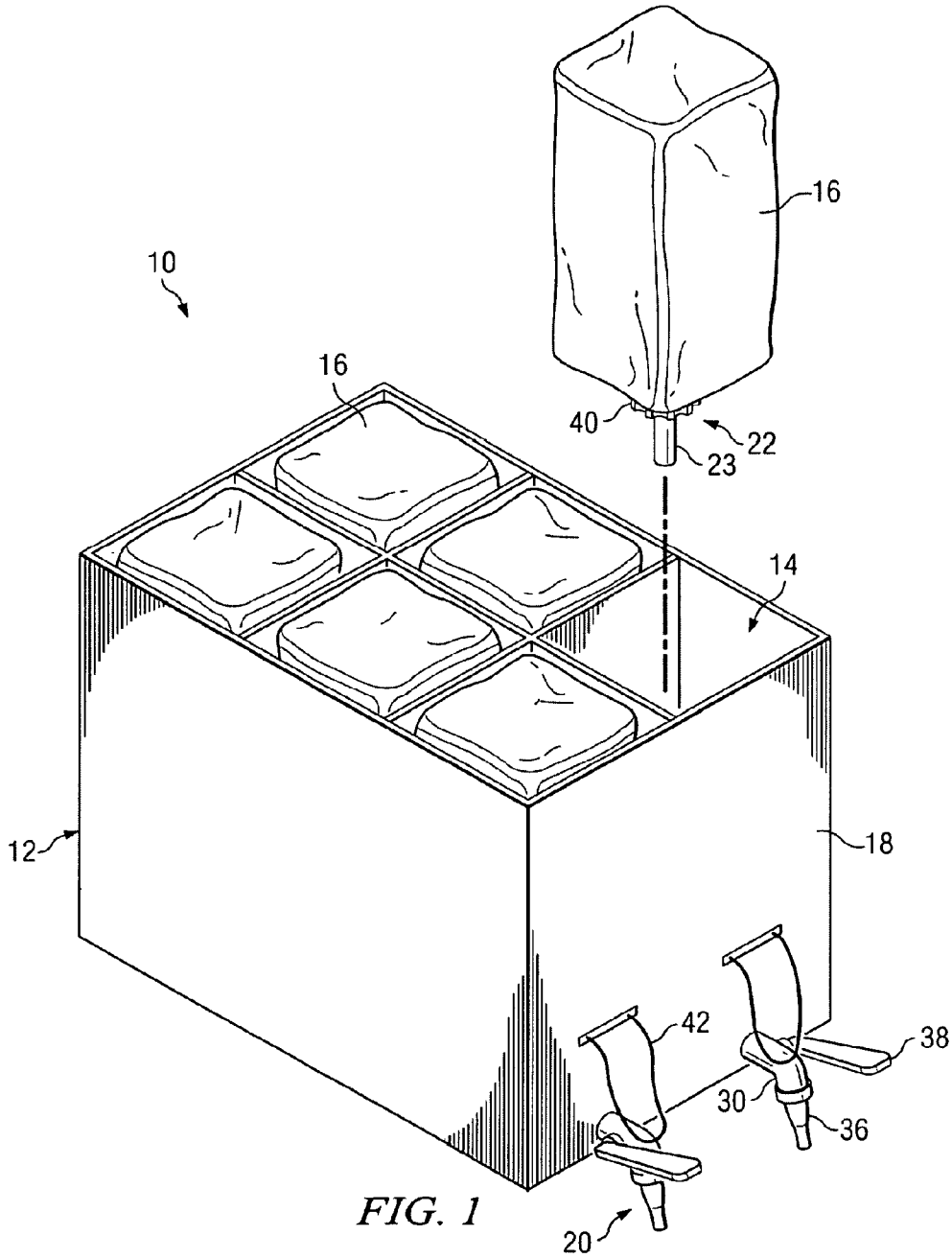
FIG. 1 is perspective view illustrating an alcoholic beverage dispenser comprising one embodiment of the present invention.

Referring now to the Drawings, and particularly to FIG. 1, there is shown an alcoholic beverage dispenser 10 comprising one embodiment of the present invention. The dispenser 10 comprises a base 12 having multiple compartments 14 therein, each compartment for receiving an individual container 16 containing 1.75 Liter or less of an alcoholic beverage. Within the base 12 and extending from a dispensing end 18 of the base 12 is a dispensing system 20 for dispensing liquid from the individual containers 16 received in the compartments 14 into a receiving outlet such as a tap, drink dispenser, or an individual glass. Once the individual containers 16 have been received into the dispenser 10 and the dispensing system 20 is coupled with a receiving outlet a bartender is able to dispense the entirety of the alcoholic beverage contained in the individual containers 16 without requiring removal, replacement, and reconnection of any additional containers 16. The bartender need only remove and replace individual containers 16 within the compartments 14 as time allows to enable additional dispensing capacity for future need.

Figure 2:
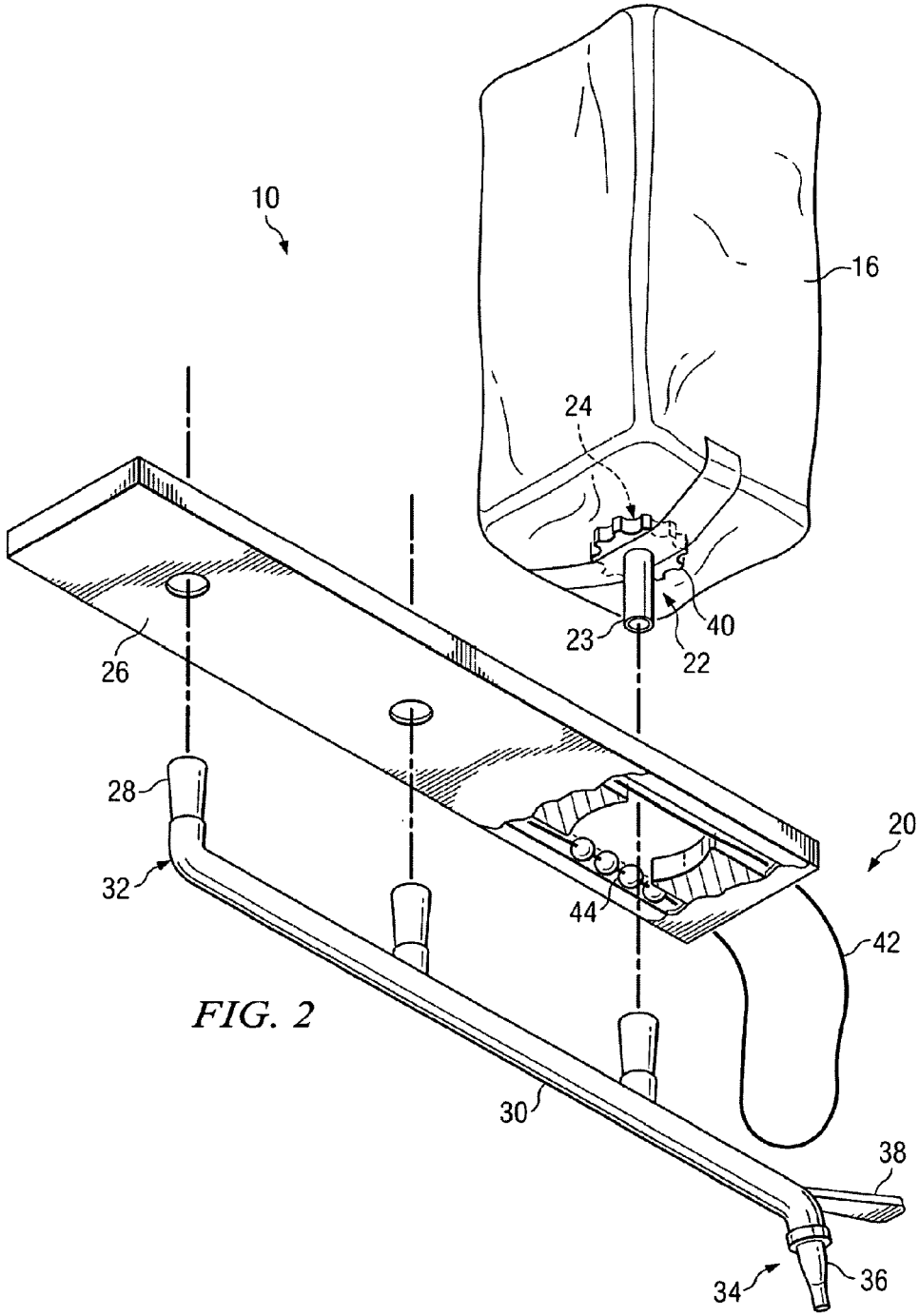
FIG. 2 is a perspective view of a dispensing system comprising one aspect of the alcoholic beverage dispenser shown in FIG. 1.

Referring now to FIG. 2, there is shown the dispensing system 20 of the dispenser 10. The dispensing system 20 comprises a valve 22 having a stem 23 extending therefrom which secures onto an opening 24 of each individual container 16. The valve 22 is received into a valve control plate 26 and the valve stem 23 is received in a valve receiving stem 28 of a manifold tube 30 located beneath the plate 26. The manifold tube 30 comprises a proximal end 32 and a distal end 34, the distal end 34 protruding through the dispensing end 18 of the base 12. The distal end 34 of the manifold tube 30 comprises a connector 36 for connecting the dispenser 10 with a receiving outlet for the alcoholic beverage and a control valve 38 for controlling the flow of the alcoholic beverage from the dispenser 10 into the connected receiving outlet.

Figure 3:
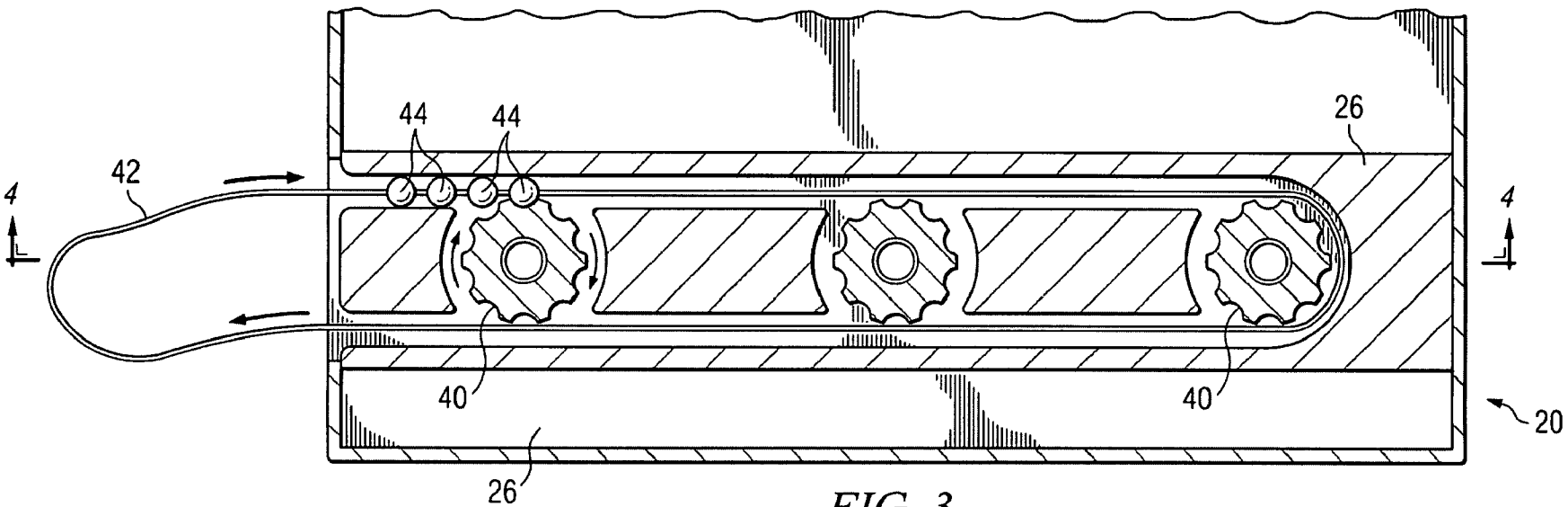
FIG. 3 is section view of the dispensing system shown in FIG. 2.

FIG. 3 comprises a sectional view of the valve control plate 26 shown having valves 22 seated therein. Each valve 22 comprises a gear wheel 40 thereon. The valve control plate 26 is provided with a lanyard 42 comprising gear engaging beads 44 thereon. As the lanyard 42 is rotated in a counterclockwise direction the beads 44 engage and rotate the gear wheel 40 to open the valve 22 thereby facilitating flow of liquid from the individual container 16. The lanyard 42 may be rotated such that flow may be initiated from one or more individual containers 16 at the same time as needed by the bartender.

Figure 4:
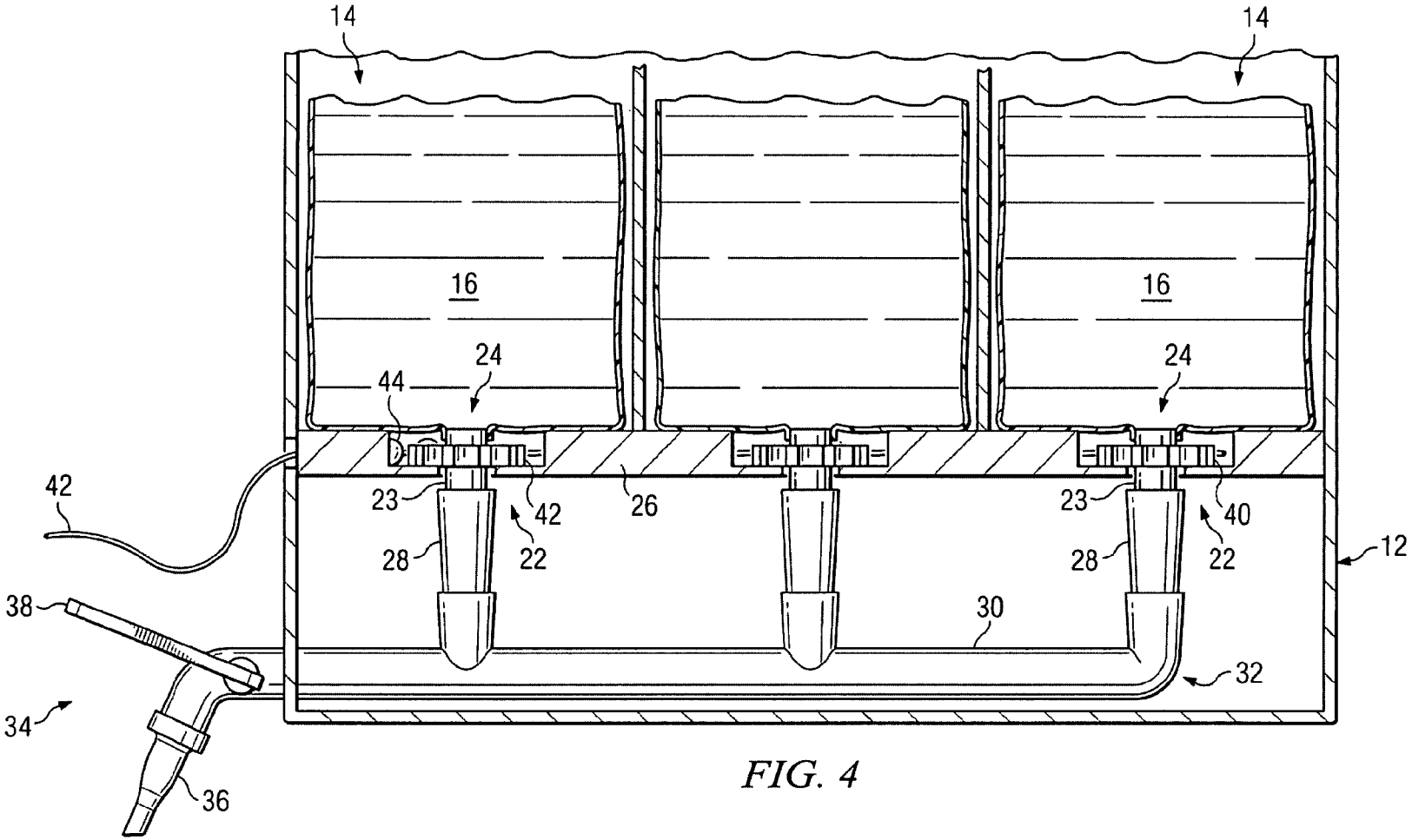
FIG. 4 is a section view of the alcoholic beverage dispenser and dispensing system.

FIG. 4 illustrates the lanyard 42 engaging only one of the containers 16 to facilitate flow of an alcoholic beverage into the pipe of the dispensing system whereafter the beverage will pass through the connector 36 and through to a receiving outlet such as a tap, drink dispenser, or an individual glass.

The dispenser 10 may comprise cardboard and other fiber-based materials, polymers, metals, and other materials suitable for beverage containment and dispensing systems known to those skilled in the art. The individual container 16 may comprise fiber-based materials, polymers and other suitable malleable materials for constructing beverage containers. Although the embodiment of the dispenser 10 shown in FIGS. 1 and 4 comprises six compartments 14, the dispenser 10 may be configured with any number of compartments 14 as required by an end user of the dispenser 10.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. An alcoholic beverage dispenser comprising:

a base having multiple compartments therein, each compartment for receiving an individual beverage container;

a plurality of valves each for engaging an opening of an individual beverage container for controlling the flow of liquid from the individual beverage container;

a dispensing system within the base for receiving liquid from all of the individual beverage containers and dispensing the received liquid to a receiving outlet;

wherein the dispensing system comprises:

a valve comprising a gear wheel thereabout and having a stem extending therefrom, the valve secured about the opening of a beverage container;

a valve receiving plate comprising a lanyard having gear engaging beads hereon, the lanyard extending outwardly from the base and rotatable within the valve receiving plate;

a manifold tube having a proximal end and a distal end and plurality of receiving stems for receiving the valve stems, wherein the distal end extends outwardly from the base;

a connector on the distal end of the manifold tube for connecting the dispensing system with the receiving outlet; and a control valve for controlling the flow of liquid through the connector into the receiving outlet.

* * * * *